US006040785A

United States Patent [19]

Park et al.

[11] Patent Number: 6,040,785

[45] Date of Patent: Mar. 21, 2000

[54] MIXED LOCK TYPE TOLL COLLECTING SYSTEM AND METHOD FOR TOLL COLLECTION OF VEHICLES ON TOLL ROAD

[76] Inventors: Won-seo Park, 221-1102 Woosung Sibeom Apt., Seohyun-dong Bundang-gu, Sungnam-city, Kyungki-do; Wan-chol Ho, 102-2001 Hankook Apt., Yeokgok-dong, Wonmi-gu, Bucheon-city, Kyungki-do; Duk-Kyun Ryu, 249-204 Jugong Apt., Wonmoon-dong, Kwacheon-city, Kyungki-do; Jong-yeob Kim, 605-102 Chowon Hanyang Apt., Pyeongchon-dong, Dongan-gu, Anyang-city, Kyungki-do, all of Rep. of Korea

[21] Appl. No.: 09/030,320

[22] Filed: Feb. 25, 1998

[30] Foreign Application Priority Data

Apr. 18, 1997 [KR] Rep. of Korea ..... 97-14459

[51] Int. Cl.[7] ..... G08G 1/00

[52] U.S. Cl. ..... 340/928; 340/933; 340/937

[58] Field of Search ..... 347/928, 905, 347/933, 937

[56] References Cited

U.S. PATENT DOCUMENTS

| | | |
|---|---|---|
| 3,090,941 | 5/1963 | Breese . |
| 3,705,976 | 12/1972 | Platzman . |
| 3,794,966 | 2/1974 | Platzman . |
| 3,872,283 | 3/1975 | Smith . |
| 3,914,733 | 10/1975 | Viracola . |
| 3,927,389 | 12/1975 | Neeloff . |
| 4,493,103 | 1/1985 | Yamashita . |
| 4,789,941 | 12/1988 | Nunberg . |
| 4,947,353 | 8/1990 | QuinLan, Jr. . |
| 4,963,723 | 10/1990 | Masada . |

(List continued on next page.)

FOREIGN PATENT DOCUMENTS

| | | |
|---|---|---|
| 54-133899 | 10/1979 | Japan . |
| 59-49298 | 4/1984 | Japan . |
| 64-80834 | 3/1989 | Japan . |
| 64-80835 | 3/1989 | Japan . |
| 2-277198 | 11/1990 | Japan . |
| 5-217041 | 8/1993 | Japan . |
| 6-309588 | 11/1994 | Japan . |
| 8-86614 | 4/1996 | Japan . |
| 8-221615 | 8/1996 | Japan . |
| 8-221617 | 8/1996 | Japan . |
| 8-221620 | 8/1996 | Japan . |
| 8-235489 | 9/1996 | Japan . |
| 8-305914 | 11/1996 | Japan . |
| 9-62982 | 3/1997 | Japan . |
| 9-62984 | 3/1997 | Japan . |
| 9-259388 | 10/1997 | Japan . |

*Primary Examiner*—Edward Lefkowitz

[57] ABSTRACT

A toll collecting system having a lock-type management for toll collection of vehicles in a toll road such as an express way. The mixed lock-type toll collecting system includes an on-board unit installed in a vehicle which enters an entrance gate and exits an exit gate of the toll road, for toll collection by radio communication; an entrance lane device installed at the entrance gate for transmitting entrance information to the vehicle which enters the entrance gate; an exit lane device installed at the exit gate for collecting the toll from the vehicle which exits the exit gate; and a central control device for controlling the entrance lane device and the exit lane device for toll collection of the vehicle which enters the entrance gate and exits the exit lane of the toll road. A radio communicator is used to provide entrance information to the vehicle by radio communication at the entrance gate for subsequent toll collection upon exit in case radio communication can be performed. A pass is alternatively provided to the driver of the vehicle at entry for subsequent toll collection upon exit when radio communication with the on-board unit of the vehicle cannot be performed. The combination of electronics and manual toll collection of the mixed toll collecting system of the present invention can significantly reduce the time for collecting the toll and prevent traffic jams at the toll gate.

25 Claims, 5 Drawing Sheets

U.S. PATENT DOCUMENTS 5,101,200 3/1992 Swett .
5,204,675 4/1993 Sekine .
5,392,034 2/1995 Kuwagaki .
5,422,473 6/1995 Kamata .
5,451,758 9/1995 Jesadanont .
5,528,234 6/1996 Mani .
5,602,375 2/1997 Sunahara et al. .
5,686,906 11/1997 Ono et al. ..... 340/928
5,734,337 3/1998 Kupersmit .
5,750,069 5/1998 Lew et al. .

MIXED LOCK TYPE TOLL COLLECTING SYSTEM AND METHOD FOR TOLL COLLECTION OF VEHICLES ON TOLL ROAD

CLAIM FOR PRIORITY

This application makes reference to, incorporates the same herein, and claims all benefits accruing under 35 U.S.C. §119 from my application entitled Mixed Look Type Toll Collecting System for Toll Collection of Vehicles on Toll Road filed in the Korean Industrial Property Office on Apr. 18, 1997, and there duly assigned Serial No. 97-14459, a copy of which application is annexed hereto.

BACKGROUND OF THE INVENTION

1. Technical Field

The present invention relates to a toll collecting system, and more particularly, to a system for collecting tolls from vehicles on a toll road such as an expressway using a lock-type management.

2. Related Art

Contemporary toll collecting systems for toll collection of vehicles on toll roads such as expressways may be classified as a lock type or a non-lock type of system according to a particular management pattern. A lock-type toll collecting system relates to toll collection of a vehicle at the toll gate where the value of the toll is determined according to the type of vehicle and the distance traveled along the road. A non-lock type toll collecting system relates to toll collection determined according to only the type of the vehicle. Different vehicle classification systems may be used to determine the type of vehicle on the road, such as disclosed in U.S. Pat. No. 3,794,966 for Automatic Vehicle Classification And Ticket Issuing System issued to Platzman, U.S. Pat. No. 3,872,283 for Vehicle Identification Method And Apparatus issued to Smith et al., U.S. Pat. No. 3,914,733 for System Including A Pressure Switch For Counting Axles And Classifying Vehicles issued to Viracola, U.S. Pat. No. 3,927,389 for Device For Determining, During Operation, The Category Of A Vehicle According To A Pre-Established Group Of Categories issued to Neeloff, U.S. Pat. No. 4,789,941 for Computerized Vehicle Classification System issued to Nunberg, U.S. Pat. No. 4,947,353 for Automatic Vehicle Detecting System issued to Quinlan et al., and U.S. Pat. No. 5,392,034 for Vehicle Classification System Using Profile issued to Kuwagaki.

On toll roads for vehicles on which the toll depends upon the distance traveled along the road of traditional lock-type toll collecting systems, the collection of tolls requires an attendant at each toll gate of the toll road. Usually when a vehicle is about to enter a toll road, the driver of the vehicle must stop at an entrance toll gate to pick up a ticket for toll collection upon exit. Sometimes, an attendant is required at the toll gate to input information relating to the type of vehicle into a ticket machine for ticket issuance which the attendant hands to the driver. Typically the ticket may be a magnetic recorded pass or can contain punched holes in which information such as the date, the toll gate number, and the type of vehicle is encoded. Upon receipt of the ticket, the driver can enter the toll road with his vehicle.

When the driver wishes to exit from the toll road, he or she must stop at an exit toll gate and hand the ticket to an attendant at the toll gate. The attendant then inserts the ticket into a card reader which deciphers the information encoded in the punched holes of the ticket or reads the magnetic strip for toll calculation. The attendant must manually collect the toll from the driver of the vehicle before the driver can exit from the toll road. Since the toll collecting process requires human attendants, the time required to collect the toll for each vehicle is extremely exhaustive, costly and frequently causes traffic backups on the toll road near the entrances and exits. The traffic jams in turn cause pollution because of the amount of carbon monoxide that is produced, and the amount of fuel that is consumed by thousands and thousands of vehicles that must come to a full stop, stop and go, and then accelerate for the duration.

In recent years, electronics have been used for more cost efficient and reliable toll collections such as those disclosed in U.S. Pat. No. 4,963,723 for Automatic Toll Collector For Toll Roads issued to Masada, U.S. Pat. No. 5,101,200 for Fast Lane Credit Card issued to Swett, U.S. Pat. No. 5,204,675 for Toll Collecting System For A Vehicle issued to Sekine, U.S. Pat. No. 5,422,473 for Vehicle Security System And Automatic Roadway Toll Charging System issued to Kamata, U.S. Pat. No. 5,451,758 for Automatic Non-Computer Network No-Stop Collection Of Expressway Tolls By Magnetic Cards And Method issued to Jesadamont, U.S. Pat. No. 5,602,375 for Automatic Debiting System Suitable For Free Lane Traveling issued to Sunahara et al. Many recent toll collecting systems use an on-board unit installed in the vehicle for toll collection without stopping the vehicle at the toll gate by way of radio communication equipment installed at the entrance/exit toll gate. However, I have observed that the on-board unit must be installed in the vehicle, and the efficiency of the toll gate lane is lowered if there are few vehicles equipped with the on-board units.

SUMMARY OF THE INVENTION

Accordingly, it is therefore an object of the present invention to provide an improved toll collecting system and a method for efficient toll collection of vehicles on toll roads.

It is also an object to provide a mixed lock-type toll collecting system with a lock-type management in which a manned toll collecting method and a wireless toll collecting method are combined for minimizing the delay to vehicles at the toll gates.

These and other objects of the present invention can be achieved by a mixed lock-type toll collecting system which comprises an on-board unit installed in a vehicle for toll collection at a toll gate of a toll road; an entrance lane device installed at an entrance lane of the toll gate of the toll road, for transmitting entrance information to the vehicle which enters the entrance lane; an exit lane device installed at an exit lane of the toll gate of the toll road, for collecting the toll from the vehicle which exits the exit lane; and a central control device for controlling the entrance lane device and the exit lane device for toll collection from the vehicle which enters the entrance lane and exits the exit lane of the toll road.

The on-board unit which is installed in the vehicle includes an integrated circuit card processor for calculating the toll by an integrated circuit card. The entrance lane device includes at least a first radio communicator for performing radio communication with the on-board unit installed in the vehicle upon entry and transmitting the entrance information to the vehicle which enters the entrance lane, when radio communication with the on-board unit installed in the vehicle can be performed; a pass issuer for issuing a pass to the driver of the vehicle, when radio communication with the on-board unit installed in the vehicle cannot be performed; and an information display unit for providing a visual display of the entrance information transmitted to the on-board unit installed in the vehicle which enters said entrance lane. The exit lane device includes a second radio communicator for performing radio communication with the on-board unit installed in the vehicle upon exit and collecting the toll, when radio communication can be performed; a manned exit lane device for collecting the toll in accordance with the pass received from the driver of the vehicle, when radio communication with the on-board unit installed in the vehicle cannot be performed; a receipt issuer connected to the manned exit lane controller for issuing a receipt of the toll collection in accordance with inputs of a clerk stationed at the exit lane of the toll gate; a payment processor connected to the manned exit lane controller for collecting the toll in the form of a pre-paid ticket; an information display unit for providing a visual display of the toll collection to a clerk stationed at the exit lane of the toll gate; and a vehicle image photographing unit connected to the exit lane controller for photographing the vehicle which exits the exit lane of the toll gate and does not have an on-board unit installed therein. The central control device further includes an image processing computer for receiving, keeping, requesting and outputting images captured by the vehicle photographing unit of the exit lane device.

According to another aspect of the present invention, a mixed lock-type toll collecting for toll collection of vehicles on a toll road comprises an on-board unit installed in a vehicle which enters an entrance gate and exits an exit gate of the toll road for toll collection by radio communication; an entrance lane device installed at the entrance gate for transmitting entrance information to the vehicle which enters the entrance gate; an exit lane device installed at the exit gate for collecting the toll from the vehicle which exits the exit gate; and a central control device for controlling the entrance lane device and the exit lane device for toll collection of the vehicle which enters the entrance gate and exits the exit lane of the toll road.

The entrance lane device includes a first vehicle sensor for sensing the vehicle which enters the entrance lane; a second vehicle sensor for sensing the vehicle which departs from the entrance lane; a first radio communicator for performing radio communication with the on-board unit installed in the vehicle which enters the entrance lane; an entrance lane controller for receiving a vehicle arriving signal from the first vehicle sensor, performing radio communication with the on-board unit installed in the vehicle which enters the entrance lane via the first radio communicator, and transmitting entrance information to the on-board unit installed in the vehicle which enters the entrance lane when radio communication with the on-board unit installed in the vehicle can be performed; and a pass issuer connected to the entrance lane controller for giving the pass to the driver of the vehicle which enters the entrance lane in response to receipt of the vehicle arriving signal, when radio communication with the on-board unit installed in the vehicle cannot be performed.

The exit lane device comprises a third vehicle sensor for sensing the vehicle which arrives at the exit gate; a fourth vehicle sensor for sensing the vehicle which departs from the exit gate; a second radio communicator for performing radio communication with the on-board unit installed in the vehicle which arrives at the exit gate; an exit lane controller for receiving a vehicle arriving signal generated from the third vehicle sensor, performing radio communication with the on-board unit installed in the vehicle which arrives at the exit gate via the second radio communicator, receiving the entrance information from the on-board unit installed in the vehicle which arrives at the exit gate, and collecting the toll from the vehicle when radio communication with the on-board unit installed in the vehicle can be performed; a pass processor for processing the entrance information of the vehicle which arrives at the exit gate from the pass received from the driver of the vehicle and providing a visual display of the entrance information to a clerk stationed at the exit gate; and a manned exit lane controller for controlling reception of the vehicle arriving signal from the exit lane controller and directly collecting the toll from the driver of the vehicle which arrives at the exit gate when radio communication with the on-board unit installed in the vehicle cannot be performed.

According to yet another aspect of the present invention, a method for providing entrance information to a vehicle which enters an entrance gate of a toll road for toll collection at an exit gate, comprises the steps of: sensing the arrival of the vehicle at the entrance gate in which an entrance lane device is installed for transmission of entrance information to the vehicle which enters the entrance gate of the toll road; determining whether an on-board unit is installed in the vehicle for radio communication with the entrance lane device; determining the type of the vehicle which enters the entrance gate of the toll road, and increasing the number of awaiting vehicles by a unit value at the entrance gate; transmitting the entrance information to the on-board unit installed in the vehicle which enters the entrance gate of the toll road by radio communication from the entrance lane device for electronic toll collection, and providing a visual display of the result when said on-board unit is installed in the vehicle; giving a pass to a driver of the vehicle for manual toll collection when the on-board unit is not installed in the vehicle, or alternatively, when the entrance information cannot be transmitted to the on-board unit installed in the vehicle by radio communication; sensing the departure of the vehicle from the entrance gate of the toll road; and completing management of the entrance information by reducing the number of the awaiting vehicles at the entrance gate by the unit value.

According to another aspect of the present invention, a method for toll collection from a vehicle which enters an entrance gate of a toll road and now arrives at an exit gate, comprises the steps of: sensing the arrival of a vehicle at the exit gate of the toll road in which an exit lane device is installed for collecting the toll from the vehicle; determining whether an on-board unit is installed in the vehicle for radio communication with the exit lane device; determining the type of the vehicle, and increasing the number of awaiting vehicles at the exit gate by a unit value; providing a visual display of the result of toll collection from the vehicle when the on-board unit is installed in the vehicle; directly collecting the toll by receiving the pass received by a driver of the vehicle at the entrance gate when the on-board unit is not installed in the exiting vehicle, or alternatively, when the toll collection cannot be performed by radio communication; sensing the departure of the vehicle from the exit gate of the toll road; photographing the exiting vehicle when the exiting vehicle is determined to be a violating vehicle; and completing the management of toll collection from the vehicle which exits the exit gate of the toll road.

The present invention is more specifically described in the following paragraphs by reference to the drawings attached only by way of example.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
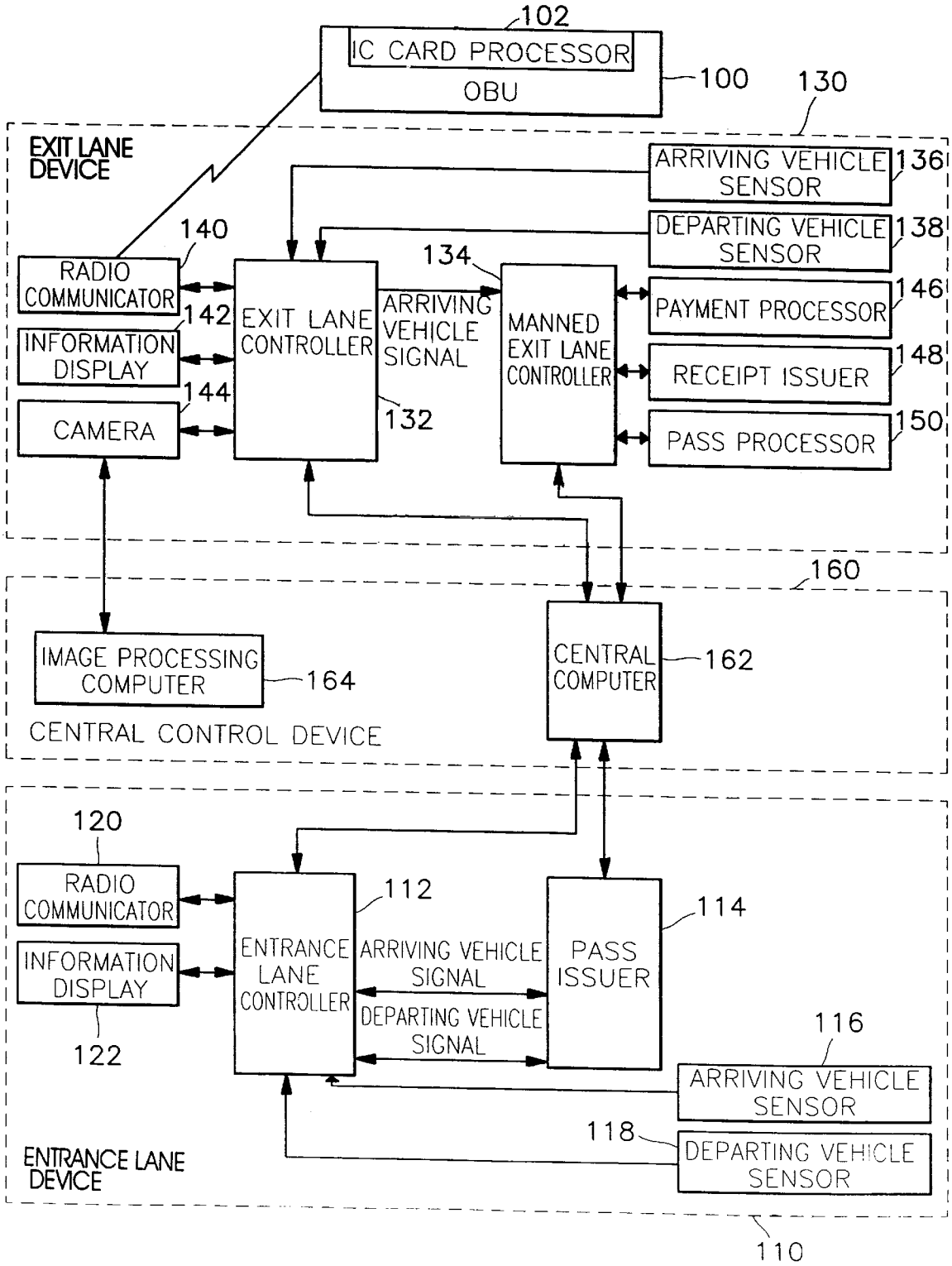
FIG. 1 is a block diagram of a mixed lock-type toll collecting system constructed according to the principles of the present invention.

Referring now to the drawings and particularly to FIG. 1, which illustrates a mixed lock-type toll collecting system constructed according to the principles of the present invention. The toll collecting system includes an on-board unit 100, an entrance lane device 110, an exit lane device 130, and a central control device 160.

As shown in FIG. 1, the entrance lane device 110 includes an entrance lane controller 112, a pass issuer 114, an arriving vehicle sensor 116, a departing vehicle sensor 118, a radio communicator 120, and an information display unit 122. The exit lane device 130 includes an exit lane controller 132, a manned exit lane controller 134, an arriving vehicle sensor 136, a departing vehicle 138, a radio communicator 140, an information display unit 142, a camera 144, a payment processor 146, a receipt issuer 148, and a pass protector 150.

The on-board unit (OBU) 100 which may be attached to the front window of the vehicle, is used to communicate with the entrance lane device 110 by a radio wave to receive entrance information therefrom when the vehicle enters the entrance toll gate. The on-board unit (OBU) 100 also performs radio communication with the exit lane device 130 when the vehicle enters the exit toll gate for toll collection without the necessity for the vehicle to stop at both the entrance toll gate and the exit toll gate. In a preferred embodiment of the present invention, the OBU 100 includes an IC card processor 102 for paying the toll with an integrated circuit (IC) card. A financial organization such as a bank, or some organization which receives the toll, inputs an amount of money to the IC card. A user pays the toll at the exit gate by inserting the IC card to which an amount of money is input into the IC card processor 102 of the OBU 100 installed inside the vehicle. The OBU 100 may be used to transmit a predetermined identification number which is used by the central control device 160 of the toll gate to extract an after-payment within a predetermined period according to an after-payment agreement.

Figures 1, 2:
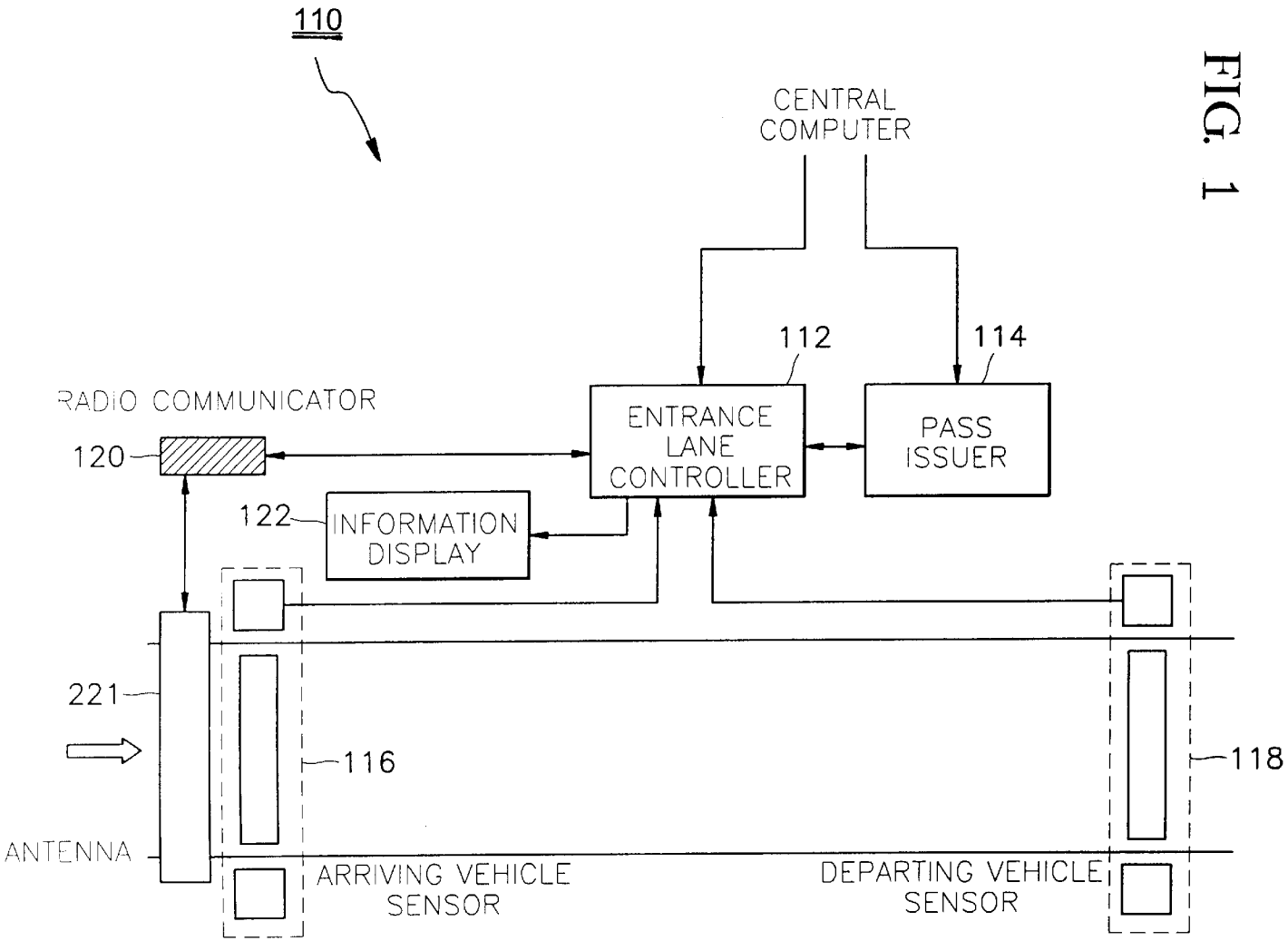
FIG. 2 illustrates an entrance lane device of the mixed lock-type toll collecting system according to the present invention.

FIG. 2 illustrates a circuit diagram of an entrance lane device 110 installed at each entrance lane of an entrance toll gate for providing vehicle entrance information. The entrance lane device 110 includes an entrance lane controller 112, a pass issuer 114, an arriving vehicle sensor 116, a departing vehicle sensor 118, an entrance radio communicator 120, and an entrance information display unit 122.

The arriving vehicle sensor 116 is installed at a predetermined position of the entrance lane, and is connected to the entrance lane controller 112 for sensing the arrival of a vehicle at the entrance lane. When the vehicle enters the entrance lane of the entrance toll gate, the arriving vehicle sensor 116 signals this event to the entrance lane controller 112. The departing vehicle sensor 118 is installed at another predetermined position of the entrance lane, and is connected to the entrance lane controller 112 for sensing the departure of the vehicle from the entrance lane. The entrance management of the vehicle is terminated by a vehicle departing signal from the departing vehicle sensor 118. At this time, the pass issuer 114 prepares to issue a pass with respect to the next vehicle. The radio communicator 120 is connected to antenna 221 performing radio communication with the OBU 100 installed in the vehicle.

The entrance lane controller 112 receives a vehicle arriving signal from the arrival vehicle sensor 116 and attempts radio communication with the OBU 100 attached to the arriving vehicle by means of the radio communicator 120. If radio communication is possible, the entrance lane controller 112 sends the entrance information to the OBU 100 attached to the vehicle. The entrance information may include information such as identification number of the toll gate, information on the type of the vehicle, and the entrance time. The entrance lane controller 112 transfers the result of providing the vehicle the entrance information by radio communication to the central computer 162 of the central control device 160.

If the entrance lane controller 112 cannot perform radio communication with any OBU 100 attached to the vehicle, the pass issuer 114 receives the vehicle arriving signal from the entrance lane controller 112 and issues the pass to the driver. The pass issuer 114 transfers the result of management of the pass issuing to the central computer 162 of the central control device 160. The information display 122 displays the result of the entrance lane controller 112 sending the OBU 100 the entrance information on the entering vehicle, to the driver of the entering vehicle.

Figure 3:
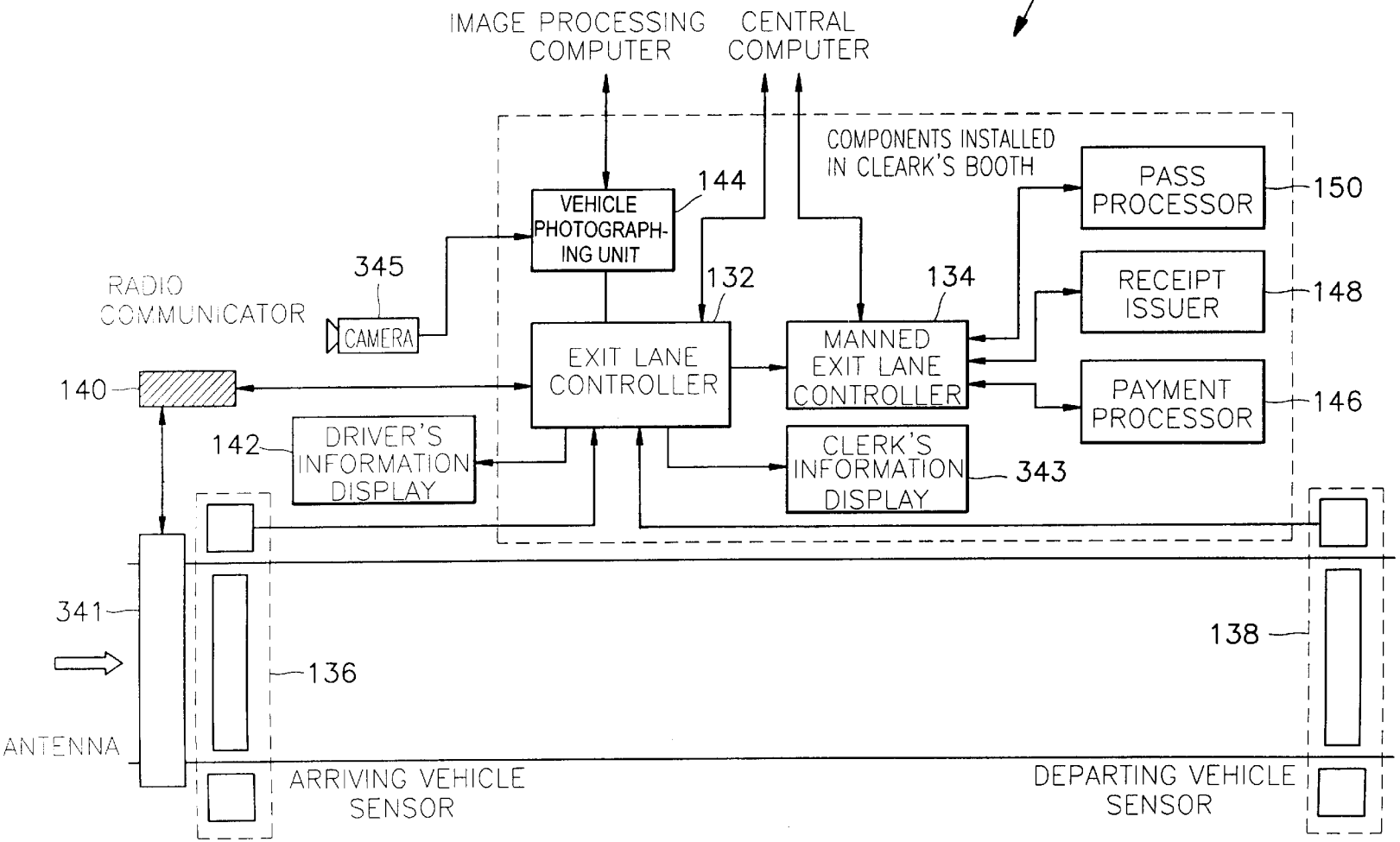
FIG. 3 illustrates an exit lane device of the mixed lock-type toll collecting system according to the present invention.

FIG. 3 illustrates an exit lane device 130 of the mixed lock-type toll collecting system as installed in each lane of the toll gate for collecting tolls from vehicles according to the present invention. As shown in FIG. 3, the exit lane device 130 includes an exit lane controller 132, a manned lane exit controller 134, an arriving vehicle sensor 136, a departing vehicle sensor 138, a radio communicator 140, a drivers information display 142, a vehicle photographing unit 144, a payment processor 146, a receipt issuer 148, a clerks information display 343, a camera 345, and a pass processor 150. The exit lane controller 132, the manned exit lane controller 134, the clerk's information display 343, the vehicle photographing unit 144, the payment processor 146, the receipt issuer 148, and the pass processor 150 are installed in the booth at which the clerk works.

The arriving vehicle sensor 136 is installed for sensing a vehicle arriving at the lane in which the exit lane device 130 is installed. The entering vehicle sensor 136 signals this event to the exit lane controller 132. The departing vehicle sensor 138 is connected to the exit lane controller 132 for sensing a vehicle departing from the exit lane area in which the exit lane device 130 is installed. The toll collecting from the vehicle is terminated by the vehicle departing signal from the departing vehicle sensor 138. The radio communicator 140 is connected to antenna 341 for performing radio communication with the OBU 100.

The exit lane controller 132 receives a vehicle arriving signal from the arriving vehicle sensor 136 and attempts radio communication with the OBU 100 attached to the arriving vehicle by means of the radio communicator 140. If radio communication is possible the exit lane controller 132 obtains the entrance information given at the entrance toll gate by radio communication with the OBU 100 attached to the vehicle and collects the toll which is calculated using lock-type methods. The exit lane controller 132 transfers the result of management according to a lock-type electronic toll collecting method to the central computer 162 of the central control device 160.

If the exit lane controller 132 cannot perform radio communication with any OBU 100 attached to the vehicle, the manned exit lane controller 134 receives the vehicle arriving signal from the exit lane controller 132, directly receives the pass from the driver, and controls the steps of collecting the toll according the pass. The manned exit lane controller 134 transfers the result of management according to a lock-type non-electronic toll collecting method to the central computer 162 of the central control device 160.

The driver's information display 142 is connected to the exit lane controller 132 for displaying the result of management of the radio toll collecting communication between the OBU 100 and the exit lane controller 132 to the driver. The clerk's information display 343 is also connected to the exit lane controller 132 for displaying the same information as the driver's information display 142, but displays the information to the clerk working at the toll booth.

The receipt issuer 148 is controlled by the manned exit lane controller 134 and issues a receipt according to manipulation by the clerk. The payment processor 146 is controlled by the manned exit lane controller 134 and collects the toll in the form of the pre-paid ticket given by the driver.

The vehicle photographing unit 144 is connected to the camera 345 and is controlled by the exit lane controller 132 for photographing the image of a violating vehicle including a vehicle from which the toll was not collected. Therefore, in a preferred embodiment of the present invention, when the departing vehicle is found to have committed a violation, the exit lane controller 132 receives the vehicle departing signal from the departing vehicle sensor 138 and operates the vehicle photographing unit 144.

In a preferred embodiment of the present invention, the central control device 160 includes a central computer 162 and an image processing computer 164, and is used for receiving, recording, requesting, and processing information on the management of the toll collecting from the entrance/exit lane devices 110 and 130, and controlling the operations of the entrance/exit lane devices 110 and 130.

The central computer 162 receives the information related to the management of the toll collecting from the entrance/exit lane controllers 112 and 132, the pass issuer 114 and the manned exit lane controller 134 included in the respective entrance/exit lane devices 110 and 130 of the toll gates for recording and outputting the same information or a processing report. The image processing computer 164 receives the image information of violating vehicles photographed by the vehicle photographing unit 144 included in each of the exit lane devices 130 of the toll gate, and stores, requests, and outputs the same.

Figure 4:
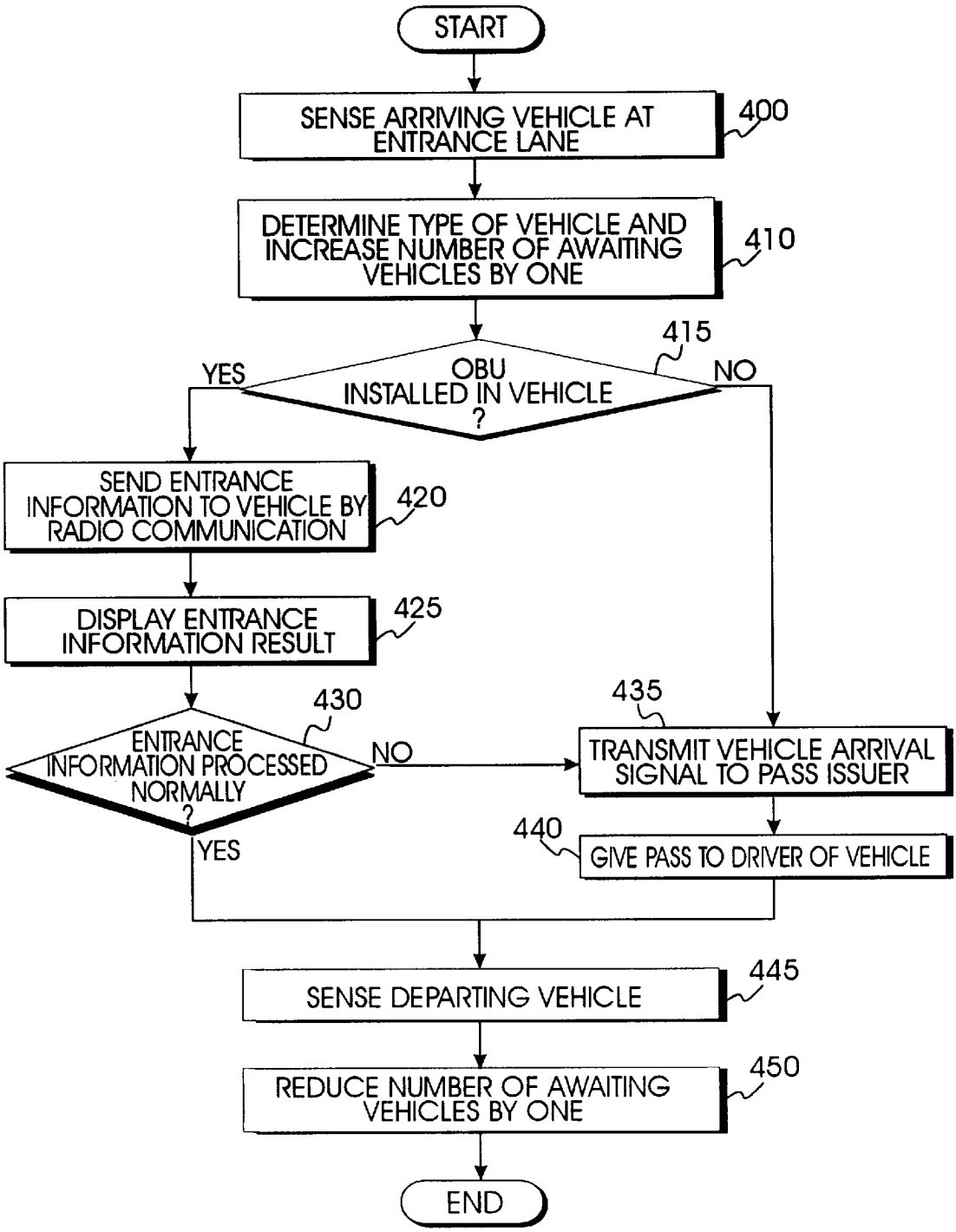
FIG. 4 is a flow chart of a process of providing entrance information to a vehicle entering an expressway through an entrance lane device of the mixed lock-type toll collecting system according to the present invention.

Now, the operation of the entrance lane device 130 of the mixed lock-type toll collecting system for providing entrance information to vehicles entering the toll road according to the present invention will be explained in detail with reference to FIG. 4 hereinbelow.

First, the arriving vehicle sensor 116 senses a vehicle which arrives at the entrance lane in which the entrance lane device 110 is installed at step 400. When the vehicle arriving signal generated in the arriving vehicle sensor 116 is transmitted to the entrance lane controller 112, the entrance lane controller 112 instructs the arriving vehicle sensor 116 to sense the data for determining the type of the vehicle and transmit the same to the entrance lane controller 112. The entrance lane controller 112 then increases the number of the awaiting vehicles by one after receiving the type of the arriving vehicle from the arriving vehicle sensor 116 at step 410.

After the type of vehicle is determined at step 410, the arriving vehicle sensor 116 determines whether an OBU 100 is installed in the arriving (entering) vehicle at step 415. When the arriving vehicle has an OBU 100 installed therein at step 415, the entrance lane controller 112 sends the entrance information of the arriving vehicle to the OBU 100 installed in the arriving vehicle by radio communication at step 420. Continuously, the information display 122 displays the result of the above management to the driver of the arriving vehicle at step 425.

When the arriving vehicle does not have an OBU 100 installed therein at step 415 or the entrance information cannot be processed by radio communication at step 430, the pass issuer 114 receives the information of the vehicle signal and the type of the vehicle from the entrance lane controller 112 at step 435 and directly gives a pass to the driver of the vehicle at step 440. Then, when the arriving vehicle departs from the entrance lane in which the entrance lane device 110 is installed, the departing vehicle sensor 118 senses the departure and transmits a vehicle departing signal to the entrance lane controller 112 at step 445. Then, the toll collecting from that vehicle by the entrance lane device 110 is completed by reducing the number of the awaiting vehicles by one at step 450.

Figure 5:
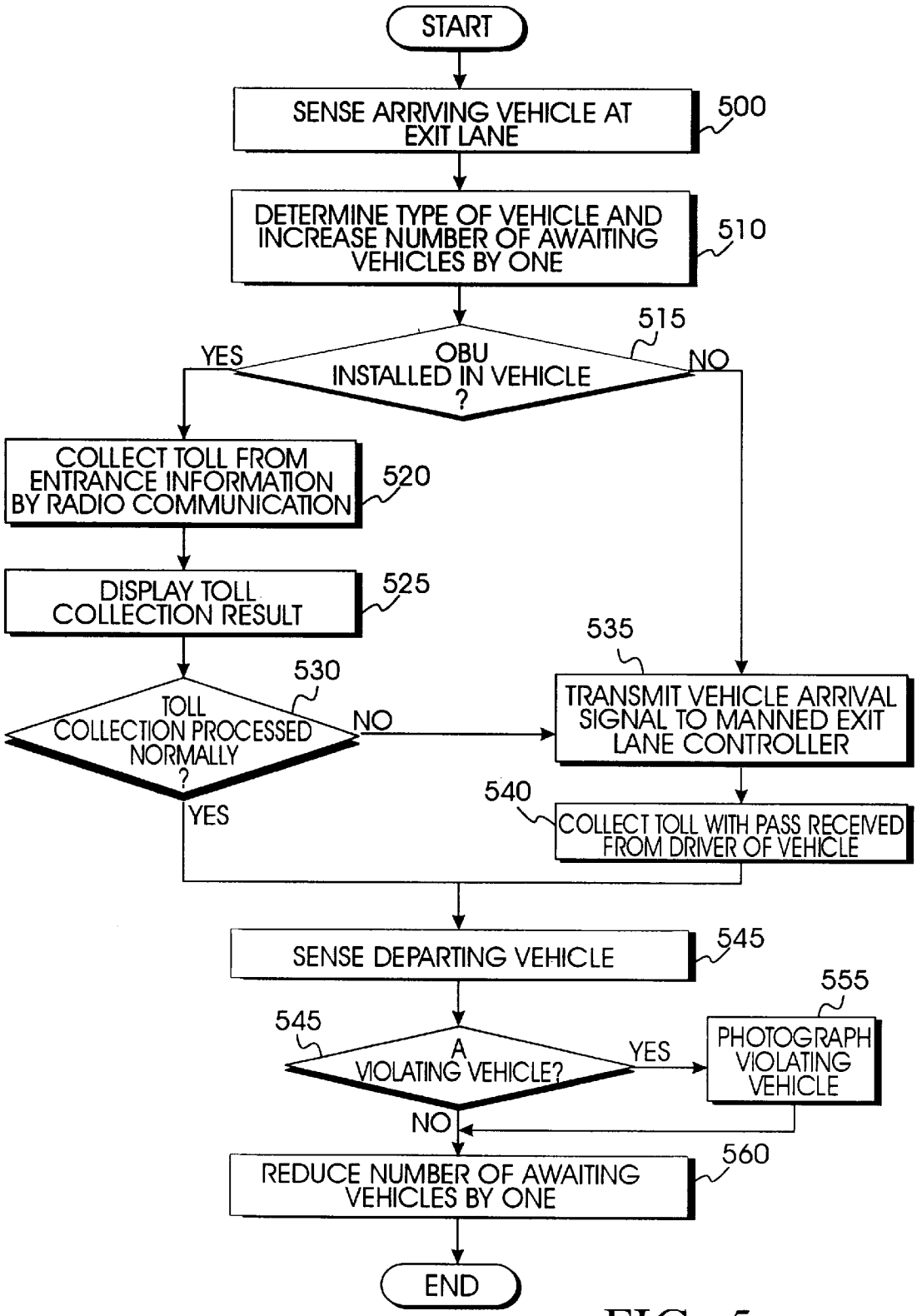
FIG. 5 is a flow chart of a process of collecting toll through an exit lane device of the mixed lock-type toll collecting system according to the present invention.

FIG. 5 illustrates a process of collecting toll through an exit lane device 130 of the mixed lock-type toll collecting system according to the present invention. Steps 500 through 515 as shown FIG. 5 are similar to those from 400 to 415 of FIG. 4 to determine the type of vehicle which arrives at the exit lane in which the exit lane device 130 is installed.

When the vehicle arriving at the exit lane in which the exit lane device 130 is installed is determined to have an OBU 100 at step 515, the exit lane controller 132 checks the entrance information which the arriving vehicle received at the entrance toll gate and collects the toll from the entrance information by radio communication with the OBU 100 at step 520. The exit lane controller 132 provides a visual display of the electronic toll collecting management result to the driver and the clerk be means of the driver's information display 142 and the clerk's information display 343 at step 525.

When the exiting vehicle does not have an OBU 100 installed therein at step 515 or the toll collection cannot be performed by radio communication at step 530, the manned exit lane controller 134 receives information on the vehicle arriving signal and the type of the vehicle from the exit lane controller 132, receives the pass which the exiting vehicle received at the entrance toll gate from the driver of the exiting vehicle, and directly collects the lock-type toll at steps 535 and 540. Then, when the exiting vehicle departs from the exit lane in which the exit lane device 130 is installed, the departing vehicle sensor 138 senses the departure and transmits a vehicle departing signal to the exit controller 132 at step 545.

The exit lane controller 132 next determines whether the vehicle departing from the exit lane in which the exit lane device 130 is installed is a violating vehicle at step 545. If the vehicle is determined to be the violating vehicle, the exit lane controller 132 controls the vehicle photographing unit 144 to photograph the violating vehicle at step 555. Then, the toll collecting from the vehicle is completed by reducing the number of the awaiting vehicles by one at step 560.

As described above, the mixed lock-type toll collecting system with a lock-type management constructed according to the present invention advantageously reduces the toll collecting time and minimize traffic jams at the toll gate by performing both the radio communication toll collecting method and the manned toll collecting method in the same lane of the toll gate. In addition, the OBU installed on vehicles may continue to serve as basic equipment for collecting traffic information.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. A mixed lock-type toll collecting system, comprising:

an on-board unit for installation in a vehicle for toll collection at a toll gate of a toll road;

an entrance lane device for installation at an entrance lane of said toll gate of the toll road for transmitting entrance information to the vehicle entering the entrance lane;

an exit lane device for installation at an exit lane of said toll gate of the toll road for collecting a toll from the vehicle exiting the exit lane;

a central control device for controlling said entrance lane device and said exit lane device for toll collection from the vehicle entering the entrance lane and exiting the exit lane of the toll road;

said entrance lane device comprising a first radio communicator performing radio communication with said on-board unit when installed in the vehicle which enters the entrance lane and transmitting the entrance information to said on-board unit when installed in the vehicle which enters the entrance lane when radio communication with the vehicle can be performed, and including a pass issuer issuing a pass to a driver of a vehicle when radio communication with the vehicle cannot be performed; and said exit lane device comprising a second radio communicator performing radio communication with said on-board unit when installed in the vehicle upon exiting and collecting the toll, when radio communication with the vehicle can be performed; and a manned exit lane device for installation collecting the toll in accordance with the pass issued to the driver of the vehicle, when radio communication with the vehicle can not be performed.

2. The mixed lock-type toll collecting system of claim 1, further comprised of said on-board unit comprising an integrated circuit card processor calculating the toll by an integrated circuit card.

3. The mixed lock-type toll collecting system of claim 1, further comprised of said exit lane device comprising a receipt issuer connected to said manned exit lane device issuing a receipt of said toll collection in accordance with an input of a clerk stationed at the exit lane of the toll gate.

4. The mixed lock-type toll collecting system of claim 1, further comprised of said exit lane device comprising a payment processor connected to said manned exit lane device for collecting the toll in the form of a pre-paid ticket.

5. The mixed lock-type toll collecting system of claim 1, further comprised of said entrance lane device comprising an information display unit providing a visual display of the entrance information transmitted to said on-board unit when installed in the vehicle which enters said entrance lane.

6. The mixed lock-type toll collecting system of claim 1, further comprised of said exit lane device comprising an information display unit for providing a visual display of said toll collection to a clerk stationed at the exit lane of the toll gate.

7. The mixed lock-type toll collecting system of claim 2, further comprised of said exit lane device comprising a vehicle photographing unit connected to said exit lane device for photographing the vehicle exiting the exit lane of the toll gate, the vehicle not having said on-board unit installed in the vehicle.

8. The mixed lock-type toll collecting system of claim 7, further comprised of said central control device comprising an image processing computer for receiving, keeping, requesting and outputting images captured by said vehicle photographing unit.

9. A mixed lock-type toll collecting system for toll collection from vehicles on a toll road, comprising:

an on-board unit for installation in a vehicle to enable toll collection by radio communication;

an entrance lane device for installation at the entrance gate at an entrance lane of the toll road for transmitting entrance information for a vehicle which enters the entrance gate;

an exit lane device for installation at an exit gate at an exit lane of the toll road for collecting a toll from the vehicle which exits the exit gate;

a central control device for controlling said entrance lane device and said exit lane device for toll collection from the vehicle entering the entrance gate and exiting the exit lane of the toll road;

said entrance lane device comprising:

a first vehicle sensor sensing the vehicle which enters the entrance lane;

a second vehicle sensor sensing the vehicle which departs from the entrance lane;

a first radio communicator performing radio communication with the on-board unit when installed in the vehicle which enters the entrance lane;

an entrance lane controller receiving a vehicle arriving signal from said first vehicle sensor, performing radio communication with said on-board unit when installed in the vehicle which enters the entrance lane via said first radio communicator when radio communication with the vehicle can be performed, and transmitting entrance information to said on-board unit when installed in the vehicle which enters the entrance lane when radio communication with the vehicle can be performed; and a pass issuer connected to said entrance lane controller issuing a pass to a driver of the vehicle which enters the entrance lane in response to receipt of said vehicle arriving signal, when radio communication with the vehicle cannot be performed;

said exit lane device comprising:

a third vehicle sensor sensing the vehicle which arrives at the exit gate;

a fourth vehicle sensor sensing the vehicle which departs from the exit gate;

a second radio communicator performing radio communication with said on-board unit when installed in the vehicle which arrives at the exit gate;

an exit lane controller receiving a vehicle arriving signal generated from said third vehicle sensor, performing radio communication with said on-board unit when installed in the vehicle which arrives at the exit gate via said second radio communicator when radio communication with the vehicle can be performed, receiving the entrance information from said on-board unit when installed in the vehicle which arrives at the exit gate, and collecting a toll from the vehicle when radio communication with said on-board unit when installed in the vehicle can be performed;

a pass processor processing the entrance information of the vehicle which arrives at the exit gate from the pass when the pass is issued to the driver of the vehicle and providing a visual display of the entrance information to a clerk stationed at the exit gate; and a manned exit lane controller for controlling reception of said vehicle arriving signal from said exit lane controller and directly collecting the toll from the driver of the vehicle which arrives at the exit gate when radio communication with the vehicle cannot be performed.

10. The mixed lock-type toll collecting system of claim 9, further comprised of said on-board unit comprising an integrated circuit card processor for calculating the toll by an integrated circuit card.

11. The mixed lock-type toll collecting system of claim 9, further comprised of said exit lane device additionally comprising a receipt issuer connected to said manned exit lane controller for issuing a receipt in accordance with inputs from the clerk stationed at the exit gate.

12. The mixed lock-type toll collecting system of claim 9, further comprised of said exit lane device additionally comprising a payment processor connected to said manned lane controller for collecting the toll in the form of a pre-paid ticket.

13. The mixed lock-type toll collecting system of claim 9, further comprised of said entrance lane device comprising an information display unit for providing a visual display of the entrance information transmitted to said on-board unit installed in the vehicle which enters said entrance gate.

14. The mixed lock-type toll collecting system of claim 9, further comprised of said exit lane device comprising an information display unit for providing a visual display of said toll collection to the clerk stationed at the exit gate.

15. The mixed lock-type toll collecting system of claim 9, further comprised of said exit lane device additionally comprising a vehicle image photographing unit connected to said exit lane controller for photographing a vehicle which exits the exit gate without said toll collection.

16. The mixed lock-type toll collecting system of claim 15, further comprised of said central control device comprising an image processing computer for receiving, keeping, requesting and outputting images captured by said vehicle image photographing unit.

17. A method for providing entrance information to a vehicle which enters an entrance gate of a toll road for toll collection at an exit gate, comprising the steps of:

sensing the arrival of a vehicle at the entrance gate having an entrance lane device for transmission of entrance information for the vehicle which enters the entrance gate of the toll road;

determining the type of the vehicle which enters the entrance gate of the toll road, and increasing a number of any awaiting vehicles at the entrance gate by a unit value;

determining whether an on-board unit is installed in the vehicle arriving at the entrance gate for radio communication with said entrance lane device;

transmitting the entrance information to said on-board unit when installed in the vehicle which enters the entrance gate of the toll road by radio communication from said entrance lane device for electronic toll collection when radio communication with the vehicle can be performed, and providing a visual display of the entrance information when said on-board unit is installed in the vehicle when radio communication with the vehicle can be performed;

issuing a pass to a driver of the vehicle for manual toll collection when said on-board unit is not installed in the vehicle, or alternatively, when the entrance information cannot be transmitted to said on-board unit when installed in the vehicle by radio communication;

sensing the departure of the vehicle from the entrance gate of the toll road; and completing management of the entrance information by reducing the number of any awaiting vehicles at the entrance gate by said unit value.

18. The method of claim 17, further comprised of said entrance lane device comprising:

a first vehicle sensor sensing the vehicle entering the entrance gate of the toll road;

a second vehicle sensor sensing the vehicle departing from the entrance gate of the toll road;

a radio communicator performing radio communication with the on-board unit when installed in the vehicle which enters the entrance gate of the toll road when radio communication can be performed with the on-board unit;

an entrance lane controller receiving a vehicle arriving signal from said first vehicle sensor, performing radio communication with said on-board unit when installed in the vehicle which enters the entrance gate via said radio communicator when radio communication can be performed with the on-board unit, and transmitting entrance information to said on-board unit when installed in the vehicle which enters the entrance gate when radio communication with the vehicle can be performed; and a pass issuer connected to said entrance lane controller issuing the pass to the driver of the vehicle which enters the entrance gate in response to receipt of said vehicle arriving signal, when said radio communication with the vehicle cannot be performed.

19. The method of claim 18, further comprised of said on-board unit comprising an integrated circuit card processor for calculating a toll for the vehicle by an integrated circuit card.

20. The method of claim 17, further comprised of a method for providing toll collection from a vehicle with arrives at the exit gate of the toll road, comprising the steps of:

sensing the arrival of a vehicle at the exit gate of the toll road having an exit lane device for collecting the toll from the vehicle;

determining the type of the vehicle arriving at the exit gate, and increasing the number any of awaiting vehicles at the exit gate by a unit value;

determining whether an on-board unit is installed in the vehicle for radio communication with said exit lane device;

collecting a toll from the vehicle and providing a visual display of the result of toll collection from the vehicle when said on-board unit is installed in the vehicle;

directly collecting a toll for the vehicle, the toll being indicated by a pass issued to a driver of the vehicle at the entrance gate when said on-board unit is not installed in the vehicle, or alternatively, when the toll collection cannot be performed by radio communication;

sensing the departure of the vehicle from the exit gate of the toll road;

photographing the vehicle exiting the exit gate of the toll road when the vehicle is determined to be a violating vehicle; and completing the management of toll collection from the vehicle which exits the exit gate of the toll road by reducing the number of any awaiting vehicles at the exit gate by said unit value.

21. The method of claim 20, further comprised of said entrance lane device comprising:

a first vehicle sensor sensing the vehicle entering the entrance gate of the toll road;

a second vehicle sensor sensing the vehicle departing from the entrance gate of the toll road;

a radio communicator performing radio communication with the on-board unit when installed in the vehicle which enters the entrance gate of the toll road when radio communication can be performed with the on-board unit;

an entrance lane controller receiving a vehicle arriving signal from said first vehicle sensor, performing radio communication with said on-board unit when installed in the vehicle which enters the entrance gate via said radio communicator when radio communication can be performed with the on-board unit, and transmitting entrance information to said on-board unit when installed in the vehicle which enters the entrance gate when radio communication with the vehicle can be performed; and a pass issuer connected to said entrance lane controller issuing the pass to the driver of the vehicle which enters the entrance gate in response to receipt of said vehicle arriving signal, when said radio communication with the vehicle cannot be performed.

22. The method of claim 21, further comprised of said exit lane device comprising:

a third vehicle sensor for sensing the vehicle which arrives at the exit gate;

a fourth vehicle sensor for sensing the vehicle which departs from the exit gate;

a second radio communicator for performing radio communication with said on-board unit when installed in the vehicle which arrives at the exit gate;

an exit lane controller for receiving a vehicle arriving signal generated from said third vehicle sensor, performing radio communication with said on-board unit when installed in the vehicle which arrives at the exit gate via said second radio communicator when radio comunication can be performed with the vehicle, receiving entrance information provided from said on-board unit when installed in the vehicle which arrives at the exit gate, and collecting the toll from the vehicle when radio communication with the vehicle can be performed;

a pass processor for processing the entrance information of the vehicle which arrives at the exit gate from the pass when issued to the driver of the vehicle and providing a visual display of the entrance information to a clerk stationed at the exit gate; and a manned exit lane controller for controlling reception of said vehicle arriving signal from said exit lane controller and directly collecting the toll from the driver of the vehicle which arrives at the exit gate when radio communication with the vehicle cannot be performed.

23. A method for toll collection from a vehicle which enters an entrance gate of a toll road and arrives at an exit gate, comprising the steps of:

sensing the arrival of a vehicle at the exit gate of the toll road having an exit lane device for collecting the toll from the vehicle;

determining the type of the vehicle arriving at the exit gate, and increasing the number of any awaiting vehicles at the exit gate by a unit value;

determining whether an on-board unit is installed in the vehicle for radio communication with said exit lane device;

collecting a toll from the vehicle and providing a visual display of the result of toll collection from the vehicle when said on-board unit is installed in the vehicle;

directly collecting a toll for the vehicle, the toll being indicated by a pass issued to a driver of the vehicle at the entrance gate when said on-board unit is not installed in the vehicle, or alternatively, when the toll collection cannot be performed by radio communication;

sensing the departure of the vehicle from the exit gate of the toll road;

photographing the vehicle exiting the exit gate of the toll road when the vehicle is determined to be a violating vehicle; and completing the management of toll collection from the vehicle which exits the exit gate of the toll road by reducing the number of any awaiting vehicles at the exit gate by said unit value.

24. The method of claim 23, further comprised of said exit lane device comprising:

a first vehicle sensor for sensing the vehicle which arrives at the exit gate;

a second vehicle sensor for sensing the vehicle which departs from the exit gate;

a radio communicator for performing radio communication with said on-board unit when installed in the vehicle which arrives at the exit gate;

an exit lane controller for receiving a vehicle arriving signal generated from said first vehicle sensor, performing radio communication with said on-board unit when installed in the vehicle which arrives at the exit gate via said radio communicator when radio communication can be performed with the vehicle, receiving entrance information provided from said on-board unit when installed in the vehicle which arrives at the exit gate, and collecting the toll from the vehicle when radio communication with the vehicle can be performed;

a pass processor for processing the entrance information of the vehicle which arrives at the exit gate from the pass when issued to the driver of the vehicle and providing a visual display of the entrance information to a clerk stationed at the exit gate; and a manned exit lane controller for controlling reception of said vehicle arriving signal from said exit lane controller and directly collecting the toll from the driver of the vehicle which arrives at the exit gate when radio communication with the vehicle cannot be performed.

25. The method of claim 23, further comprised of said on-board unit comprising an integrated circuit card processor for calculating the toll by an integrated circuit card.

* * * * *

UNITED STATES PATENT AND TRADEMARK OFFICE

CERTIFICATE OF CORRECTION

PATENT NO. : 6,040,785
DATED : March 21, 2000
INVENTOR(S) : Woo-Seo Park et al.

It is certified that error appears in the above-identified patent and that said Letters Patent is hereby corrected as shown below:

Title page,
Item [56], please insert Attorney's name after the *Primary Examiner's* name,
-- *Attorney, Agent or Firm* — Robert E. Bushnell, Esq. --

Signed and Sealed this

Twenty-fourth Day of September, 2002

*Attest:*

*Attesting Officer*

JAMES E. ROGAN
*Director of the United States Patent and Trademark Office*